US011272577B2

(12) United States Patent
Nelson et al.

(10) Patent No.: US 11,272,577 B2
(45) Date of Patent: Mar. 8, 2022

(54) COMMON CONTROL PANEL FOR WATER HEATERS

(71) Applicant: Haier US Appliance Solutions, Inc., Wilmington, DE (US)

(72) Inventors: Jonathan D. Nelson, Louisville, KY (US); Patrick Cox, Shepherdsville, KY (US); Gregory L. Hutchison, Shelbyville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 466 days.

(21) Appl. No.: 16/245,454

(22) Filed: Jan. 11, 2019

(65) Prior Publication Data

US 2020/0229274 A1 Jul. 16, 2020

(51) Int. Cl.

| | |
|---|---|
| ***H05B 1/02*** | (2006.01) |
| ***F24H 1/18*** | (2006.01) |
| ***H05B 3/04*** | (2006.01) |
| ***F24H 1/00*** | (2006.01) |

(52) U.S. Cl.

CPC ..... *H05B 1/0283* (2013.01); *F24H 1/185* (2013.01); *F24H 1/0018* (2013.01); *H05B 3/04* (2013.01)

(58) Field of Classification Search

None

See application file for complete search history.

(56) References Cited

U.S. PATENT DOCUMENTS

| | | | | | |
|---|---|---|---|---|---|
| 5,005,531 | A * | 4/1991 | Nelson | F24H 1/182 | 122/19.2 |
| 5,041,825 | A * | 8/1991 | Hart | G08C 17/02 | 340/3.4 |
| 5,163,119 | A * | 11/1992 | Windon | F24H 1/182 | 122/19.2 |
| 5,477,029 | A * | 12/1995 | Skutt | F27B 17/02 | 219/390 |
| 5,693,898 | A * | 12/1997 | Fishman | G10D 1/085 | 84/267 |
| D400,971 | S * | 11/1998 | Vago | D23/318 | |
| 6,047,108 | A * | 4/2000 | Sword | A61M 5/44 | 392/470 |
| 6,349,169 | B1 * | 2/2002 | Jackson | B29C 44/1247 | 392/447 |

(Continued)

FOREIGN PATENT DOCUMENTS

JP 5967560 B2 8/2016

*Primary Examiner* — Thor S Campbell

(74) *Attorney, Agent, or Firm* — Dority & Manning, P.A.

(57) ABSTRACT

A water heater appliance is provided that includes a control panel assembly that has features that facilitate mounting of a control panel of the control panel assembly to a curved surface of the water heater appliance. For instance, the curved surface may be an outer surface of a wrapper or a shroud of the water heater appliance. Particularly, the control panel assembly includes features that permit mounting of the control panel assembly to surfaces of variable radii. Moreover, the control panel assembly includes features that facilitate access to the electrical components of the control panel during assembly and servicing of the control panel assembly. Specifically, the control panel assembly includes features that allow the control panel to hinge downward to permit easy access to the electrical components during assembly and service.

20 Claims, 9 Drawing Sheets

(56) References Cited

U.S. PATENT DOCUMENTS 6,408,634 B1 * 6/2002 Choi ..... F25D 11/022 62/127
6,619,952 B2 * 9/2003 Hohenshelt ..... F27B 17/02 432/120
6,658,204 B2 * 12/2003 Schurter ..... F24H 1/182 392/441
6,898,375 B2 * 5/2005 Henderson ..... F24H 1/182 122/494
7,409,925 B2 * 8/2008 Lannes ..... F24H 1/182 122/19.2
7,516,721 B2 * 4/2009 Syler ..... F24H 1/182 122/19.2
8,948,580 B2 * 2/2015 Rodriguez ..... B21D 53/02 392/441
9,360,231 B2 * 6/2016 Gross ..... F24H 1/182
9,933,184 B2 4/2018 Lesage et al.
2002/0189554 A1 * 12/2002 Kohler ..... F23M 11/042 122/13.01
2008/0164394 A1 * 7/2008 Khan ..... F24H 9/06 248/274.1
2011/0265779 A1 * 11/2011 Vandrak ..... F24H 9/02 126/93
2013/0043252 A1 * 2/2013 Nelson ..... F24H 1/182 220/567.3
2013/0200168 A1 * 8/2013 Buescher ..... H05B 1/0283 237/8 A
2014/0239096 A1 * 8/2014 Jacques ..... B05B 7/0025 239/412
2015/0192326 A1 * 7/2015 Aguilar ..... F24H 9/0015 137/334
2015/0338128 A1 * 11/2015 Rissler ..... F24H 9/0005 122/19.2
2016/0178118 A1 * 6/2016 Arnold ..... F24H 9/02 248/27.1
2016/0273969 A1 * 9/2016 Lesage ..... F24H 9/2014
2016/0377323 A1 * 12/2016 Ward ..... F24H 9/2007 122/14.1
2017/0016631 A1 * 1/2017 Shaffer ..... F24H 1/185
2017/0074544 A1 * 3/2017 Lesage ..... H05B 1/0283
2018/0024574 A1 * 1/2018 Goodjohn ..... G05D 23/1393 700/300
2018/0163991 A1 * 6/2018 Shaffer ..... F24H 1/185
2019/0162447 A1 * 5/2019 Subramanian ..... F24H 9/02
2020/0025416 A1 * 1/2020 Hutchison ..... F24H 9/2021

* cited by examiner

COMMON CONTROL PANEL FOR WATER HEATERS

FIELD OF THE INVENTION

The subject matter of the present disclosure relates generally to water heater appliances and more particularly to control panels for water heater appliances.

BACKGROUND OF THE INVENTION

Water heaters provide for the heating and storage of water for various uses. A heat source is provided for raising the temperature of water in a water tank. The heat energy may be supplied e.g., by gas burners, electrically resistant coils, or a heat pump using a refrigerant cycle. Typically, the water tank is surrounded by a casing and is insulated to prevent the water stowed within the water tank from heat loss before use. The casing typically includes a jacket or wrapper that wraps around the tank. The wrapper typically has a curved outer surface.

Some water heaters include a control panel, e.g., for controlling various aspects of the water heater. In some instances, the control panel is mounted to the outer surface of the wrapper or another curved surface of the casing. The radius of curvature of the curved surface of the casing can vary between different water heater platforms. Thus, a control panel must be designed for each water heater platform so that the control panel can be mounted to the curved surface of the casing. Designing and manufacturing a control panel for each water heater platform may be burdensome on resources, may increase manufacturing costs, and requires operators to install a multitude of different control panel designs.

Further, to assemble or service the electrical wires and components of control panels of conventional water heaters, operators have had to hold the control panel in one hand and connect or service the wires or electrical components using the other hand. Holding the control panel and assembling/servicing wires and components of the control panel is challenging and inconvenient.

Accordingly, a water heater appliance that addresses one or more of the challenges noted above would be useful.

BRIEF DESCRIPTION OF THE INVENTION

Aspects and advantages of the invention will be set forth in part in the following description, or may be apparent from the description, or may be learned through practice of the invention.

In one exemplary embodiment, a water heater appliance is provided. The water heater appliance includes a casing having a curved surface, wherein the curved surface of the casing has a first radius of curvature. The water heater appliance also includes a tank positioned within the casing and defining a chamber for heating water. Moreover, the water heater appliance includes a heating source in thermal communication with the tank for selectively heating water within the chamber. In addition, the water heater appliance includes a control panel assembly. The control panel assembly includes a control panel and a frame coupled or integral with the control panel and mounted to the casing, the frame having a curved contact surface engaged with and conforming to the curved surface of the casing, and wherein the curved contact surface of the frame has a second radius of curvature that is the same as or less than the first radius of curvature of the curved surface.

In another exemplary embodiment, a water heater appliance is provided. The water heater appliance includes a casing and a tank positioned within the casing and defining a chamber for heating water. Further, the water heater appliance includes a heating source in thermal communication with the tank for selectively heating water within the chamber. The water heater appliance also includes a control panel assembly. The control panel assembly includes a frame mounted to the casing and a control panel rotatably coupled with the frame between a closed position and an open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
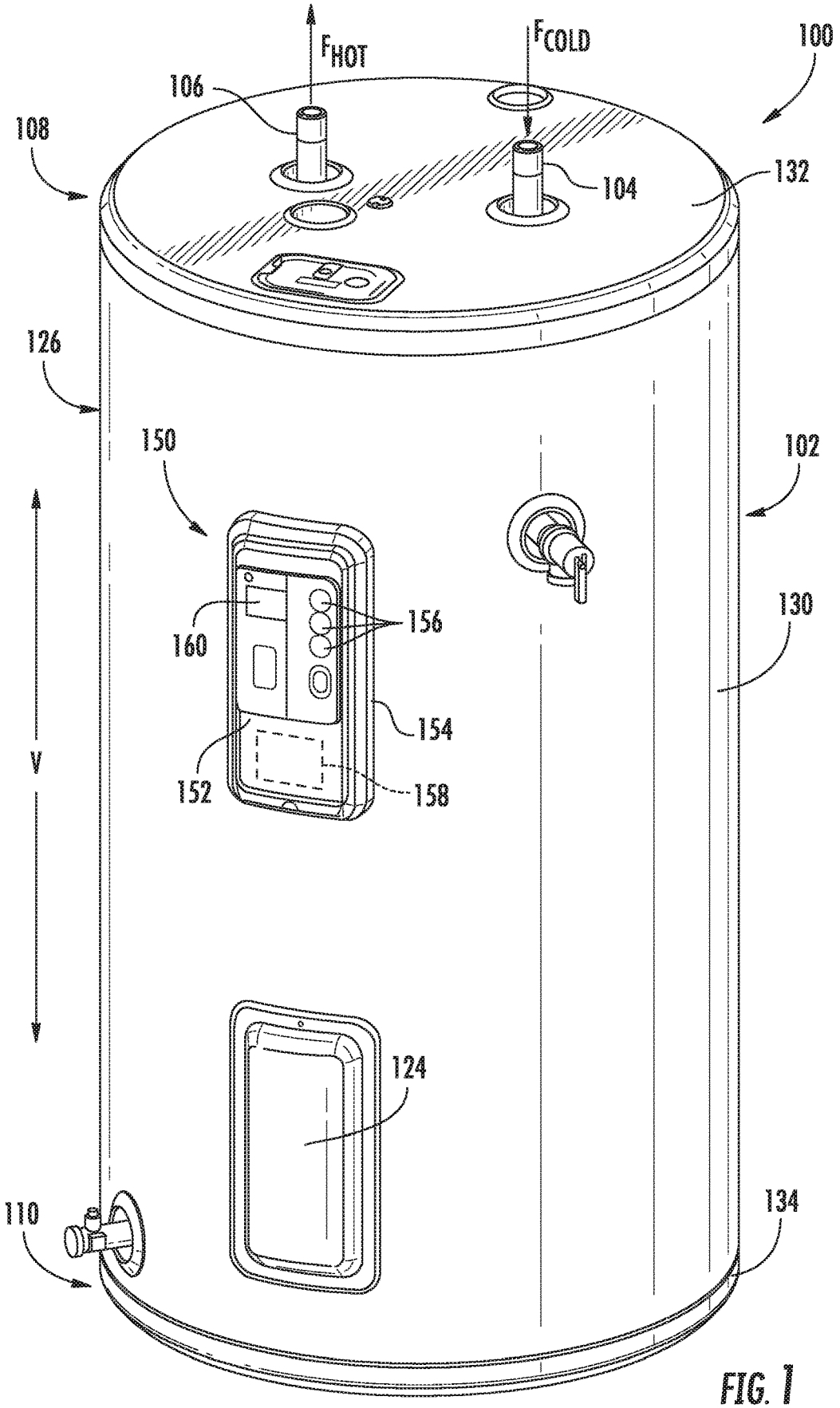
FIG. 1 provides a perspective view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "approximately," "substantially," or "about," refer to being within a ten percent (10%) margin of error.

FIG. 1 provides a perspective view of a water heater appliance 100 according to an exemplary embodiment of the present subject matter. Water heater appliance 100 includes a casing 102 that generally surrounds a tank 120 (FIG. 2) and may be formed from a variety of components. Insulation (not shown), such as foam insulation, may be disposed annularly between casing 102 and tank 120 to thermally insulate tank 120 and the water stored therein. As illustrated in FIG. 1, casing 102 may include a wrapper or jacket 130 and one or more covers, such as a top cover 132 and a bottom cover 134. The covers may be coupled to wrapper 130 to form casing 102. In some embodiments, casing 102 includes a shroud, e.g., coupled to wrapper 130 or top cover 132.

Water heater appliance 100 also includes a cold water conduit 104 and a hot water conduit 106 that are both in fluid communication with a chamber 122 (FIG. 2) defined by tank 120. As an example, cold water from a water source, e.g., a municipal water supply or a well, can enter water heater appliance 100 through cold water conduit 104 (shown schematically with arrow labeled $F_{cold}$). Cold water can enter chamber 122 of tank 120 through cold water conduit 104 wherein it is heated by a heating source 118 (FIG. 2), such as e.g., an electric heating element. Thus, heating source 118 is in thermal communication with tank 120 for selectively heating water within chamber 122 of tank 120. Such heated water can exit water heater appliance 100 at hot water conduit 106 (shown schematically with arrow labeled $F_{hot}$) and, e.g., be supplied to a bath, shower, sink, or any other suitable feature.

Water heater appliance 100 defines a vertical direction V as shown in FIG. 1. Water heater appliance 100 extends between a top portion 108 and a bottom portion 110 along the vertical direction V. Thus, water heater appliance 100 is generally vertically oriented. Water heater appliance 100 can be leveled, e.g., such that casing 102 is plumb in the vertical direction V, to facilitate proper operation of water heater appliance 100. A drain pan (not shown in FIG. 1) may be positioned at bottom portion 110 of water heater appliance 100 such that water heater appliance 100 sits on the drain pan. The drain pan may sit beneath water heater appliance 100 along the vertical direction V, e.g., to collect water.

Tank 120 (FIG. 2) is configured for storing heated water. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances. Tank 120 may have a generally cylindrically-shaped body that extends vertically between a tank bottom and a tank top. For this exemplary embodiment, water heater appliance 100 is shown as an electronically-controlled electric water heater that utilizes heating source 118 (FIG. 2), which in this embodiment is an electric resistance heating element to transfer heat to water in tank 120. However, the present subject matter is not limited to electronically-controlled electric water heaters. As will be understood by one of skill in the art using the teachings disclosed herein, the present subject matter may also be used with, e.g., water heaters that rely upon heat pump coils carrying refrigerant (i.e., heat pump water heaters), gas burners, electric heating elements, a combination thereof, and/or other heat sources as well. An access panel 124 may provide selective access to one or more heating sources 118, e.g., for maintenance.

As further shown in FIG. 1, water heater appliance 100 includes a control panel assembly 150, e.g., for controlling operation of water heater appliance 100. Generally, control panel assembly 150 includes a control panel 152 and a bezel or frame 154 coupled or integral with control panel 152. Control panel assembly 150 is mounted to water heater appliance 100 via frame 154. For this embodiment, control panel 152 is rotatably coupled with frame 154 as will be explained in detail herein. However, in some alternative embodiments, control panel 152 and frame 154 may be integrally formed as a single monolithic piece. In such embodiments, the control panel/frame component can be attached to or rotatably coupled with metal wrapper 130, e.g., via a receiver hinge. Further, in such embodiments, the control panel/frame component can be rotatably coupled with wrapper 130 such that the receiver hinge is not visible when the control panel/frame component is in a closed position.

Figure 2:
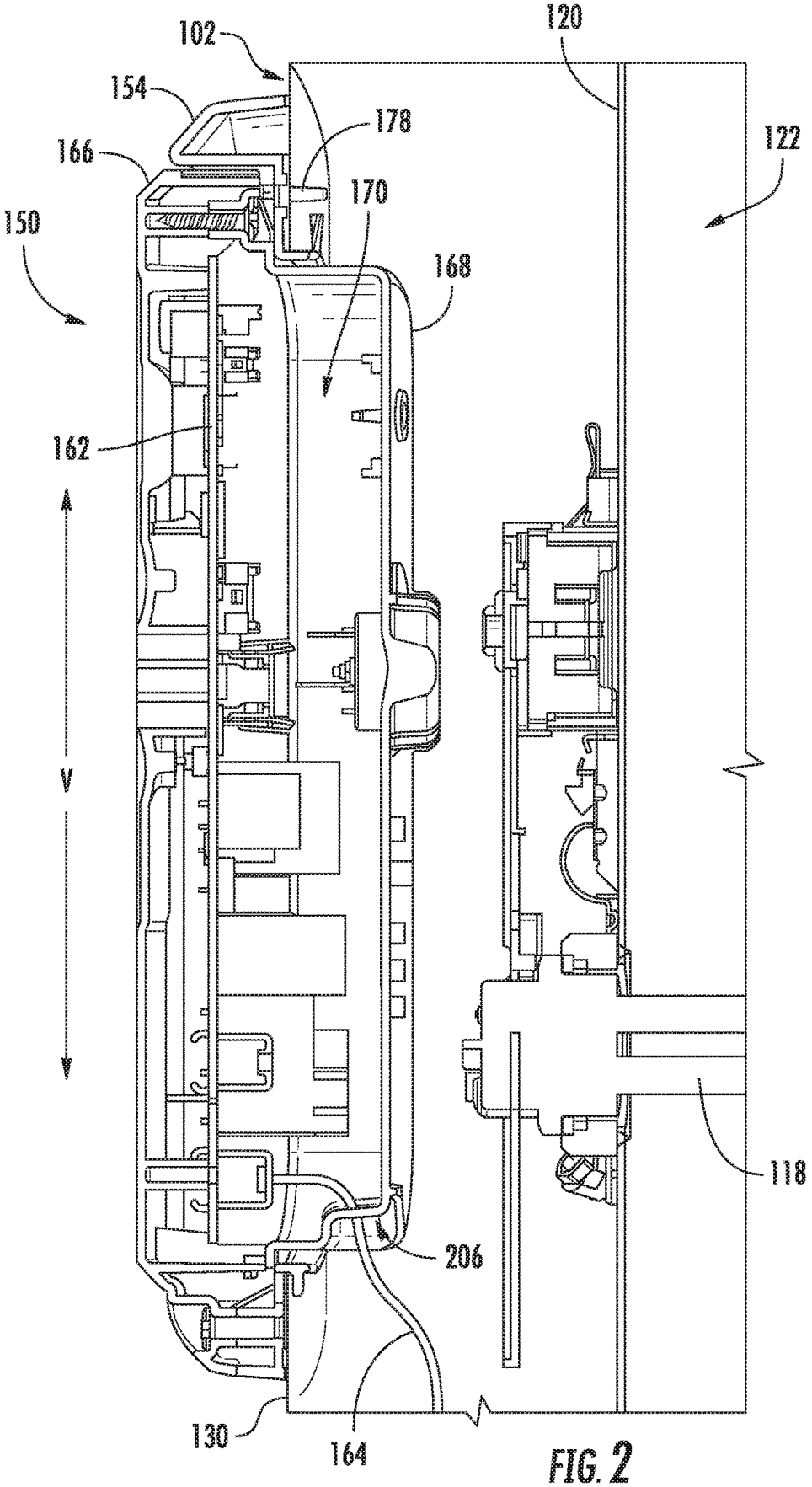
FIG. 2 provides a side cross-sectional view of an exemplary control panel assembly of the water appliance of FIG. 1.

The control panel assembly 150 may include various input components or controls 156, such as one or more of a variety of electrical, mechanical, or electro-mechanical input devices. Controls 156 may include, for example, rotary dials, knobs, push buttons, and/or touch pads. The water heater appliance 100 also includes a controller 158 communicatively coupled with controls 156 and other components of water heater appliance 100 for controlling water heater appliance 100. Controller 158 may be communicatively coupled with various components of water heater appliance 100 by any suitable wired or wireless connection. For instance, as controller 158 may be communicatively coupled with various components of control panel assembly 150 via an electronic circuit board 162 (FIG. 2). Thus, a user may select various operational features and modes via controls 156 and may monitor progress of water heater appliance 100, e.g., via a display 160, such as a digital or analog display communicatively coupled with controller 158. Display 160 may be configured to provide operational feedback to a user, among other possible items. In some embodiments, display 160 may be a touchscreen and thus one or more controls 156 may be manipulated by a user touch input to the screen. In certain embodiments, control panel represents a general purpose I/O ("GPIO") device or functional block.

As noted above, controller 158 may be communicatively coupled (i.e., in operative communication) with various components of control panel assembly 150 as well as various operational components of water heater appliance 100, such as heating source 118 (FIG. 2), sensors, etc. Input/output ("I/O") signals may be routed between controller 158 and the various components of water heater appliance 100. Thus, controller 158 can selectively activate and operate such various components. Various components of water heater appliance 100 are communicatively coupled with the controller via one or more communication lines such as, for example, conductive signal lines, shared communication busses, or wireless communications bands.

In some embodiments, controller 158 includes one or more memory devices and one or more processors. The processors can be any combination of general or special purpose processors, CPUs, or the like that can execute programming instructions or control code associated with operation of water heater appliance 100. The memory devices (i.e., memory) may represent random access memory such as DRAM or read only memory such as ROM or FLASH. In some embodiments, the processor executes programming instructions stored in memory. The memory may be a separate component from the processor or may be included onboard within the processor. Alternatively, controller 158 may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 158 includes a network interface such that controller 158 can connect to and communicate over one or more networks with one or more network nodes. Controller 158 can also include one or more transmitting, receiving, or transceiving components for transmitting/receiving communications with other devices communicatively coupled with water heater appliance 100. Additionally or alternatively, one or more transmitting, receiving, or transceiving components can be located off board controller 158. Generally, controller 158 can be positioned in any suitable location throughout water heater appliance 100. For this embodiment, controller 158 is a component of and is thus located proximate control panel assembly 150.

Figure 3:
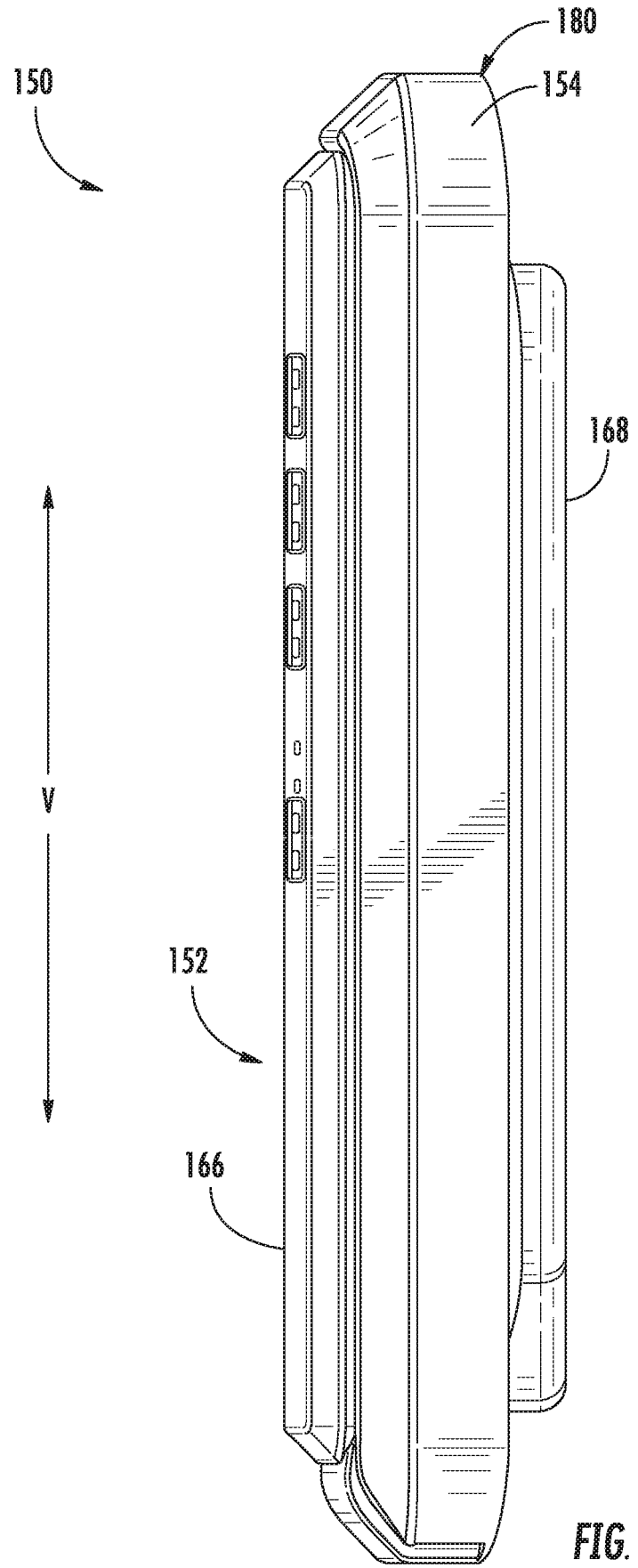
FIG. 3 provides a side view of the control panel assembly of FIG. 2 with a control panel of the assembly shown in a closed position.
Figure 4:
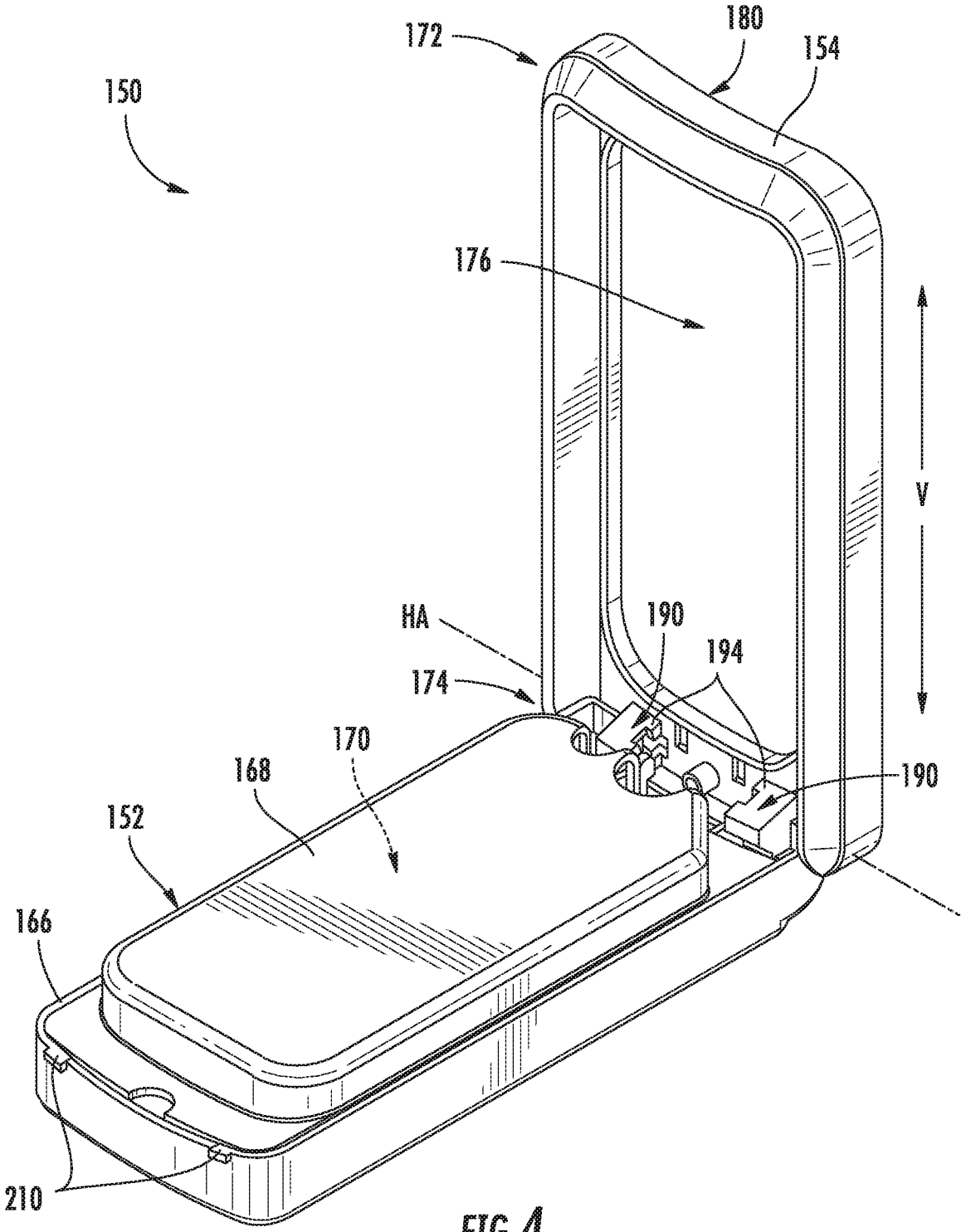
FIG. 4 provides a perspective view of the control panel assembly of FIG. 2 with the control panel shown in an open position.

FIGS. 2, 3, and 4 provide various views of the exemplary control panel assembly 150 of FIG. 1. More particularly, FIG. 2 provides a side cross-sectional view of control panel assembly 150. FIG. 3 provides a side view of control panel assembly 150 and depicts control panel 152 in a retracted or closed position. FIG. 4 provides a perspective view of control panel assembly 150 and depicts control panel 152 in a withdrawn or open position.

With reference generally to FIGS. 1, 2, 3, and 4, control panel 152 is rotatably coupled with frame 154 as shown best in FIG. 4. More specifically, control panel 152 is movable between a closed position (FIGS. 2, 3; also shown in FIG. 1) and an open position (FIG. 4). In the retracted or closed position, a user may readily manipulate controls 156 (FIG. 1), view display 160 (FIG. 1), or otherwise control water heater appliance 100 (FIG. 1) via control panel 152. In the open position, a user may readily access the contents within control panel 152, e.g., for maintenance or installation. The features that facilitate rotation of control panel 152 relative to frame 154 will be described in greater later in the disclosure. Moreover, although control panel 152 is shown as a component that is rotatably coupled with frame 154, in some exemplary embodiments, control panel 152 is not rotatably coupled to frame 154. That is, control panel 152 is not movable relative to frame 154.

As shown best in FIGS. 2 and 4, control panel 152 includes a front panel 166 and a back panel 168 coupled with or connected to front panel 166. In other exemplary embodiments, however, front panel 166 and back panel 168 may be formed as a single monolithic component. Control panel 152 defines an enclosure 170. More particularly, for this embodiment, front panel 166 and back panel 168 define enclosure 170. Enclosure 170 encloses or houses certain components, such as e.g., electronic circuit board 162 (FIG. 2), controller 158 (FIG. 1), one or more wires 164 (FIG. 2), etc. Moreover, front panel 166 may include various components mounted thereto, such as e.g., controls 156 (FIG. 1), display 160 (FIG. 1), etc.

Frame 154 is generally rectangular with rounded or bezel corners. Frame 154 is formed of a compliant plastic material. In other exemplary embodiments, frame 154 may be formed of other suitable semi-rigid, compliant materials. As shown best in FIG. 4, frame extends between a top portion 172 and a bottom portion 174, e.g., along the vertical direction V. Frame 154 defines an opening 176 in which control panel 152 is received when control panel 152 is in the closed position as best shown in FIG. 3. Particularly, when control panel 152 is in the closed position, back panel 168 of control panel 152 is received within and extends at least partially through opening 176. In addition, when control panel 152 is in the closed position, front panel 166 is at least partially received within opening 176 of frame 154. Further, control panel assembly 150 is mounted to casing 102, and more particularly, frame 154 is mounted to casing 102. Various manners in which frame 154 of control panel assembly 150 may be mounted to casing 102 are provided below.

Figure 5:
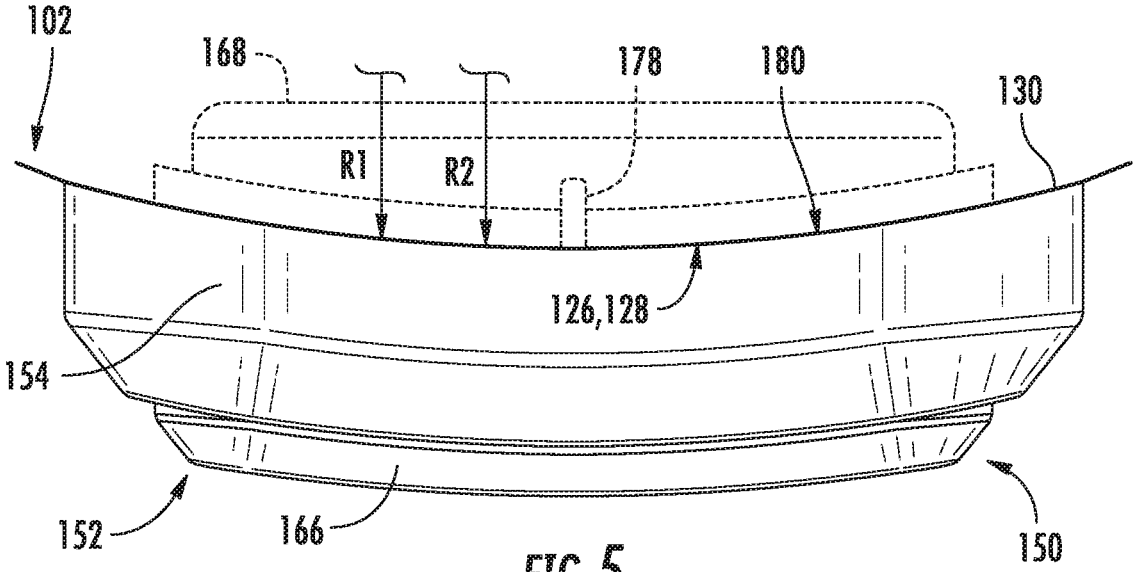
FIG. 5 provides a top view of the control panel assembly of FIG. 2 mounted to a wrapper of the water heater appliance of FIG. 1.

FIG. 5 provides a top view of the control panel assembly 150 mounted to casing 102 of water heater appliance 100 (FIG. 1). As shown, casing 102 has a curved surface 126. For the depicted embodiment of FIG. 5, curved surface 126 is an outer surface 128 of wrapper 130 (see also FIG. 1). Curved surface 126 has a radius of curvature, denoted as first radius of curvature R1. For this embodiment, curved surface 126 has a constant radius of curvature. That is, curved surface 126 has substantially the same radius no matter the point taken along the arc of curved surface 126. By way of example, the first radius of curvature R1 of curved surface 126 may be ten inches (10 in.), eleven inches (11 in.), twelve inches (12 in.), thirteen and a half inches (13.5 in.), fifteen inches (15 in.), twenty inches (20 in.), etc.

As further shown in FIG. 5, frame 154 has a curved contact surface 180 engaged with and conforming to curved surface 126 of casing 102. That is, when frame 154 of control panel assembly 150 is mounted to casing 102, curved contact surface 180 engages and conforms to curved surface 126 of casing 102. For this embodiment, curved contact surface 180 of frame 154 has a second radius of curvature R2 that is the same as the first radius of curvature R1 of curved surface 126. Thus, curved contact surface 180 is shaped complementary to curved surface 126 of wrapper 130. After engaging curved contact surface 180 of frame 154 with curved surface 126 of casing 102 during assembly, an operator may secure frame 154 to casing 102 via one or more mechanical fasteners 178. Particularly, one or more mechanical fasteners 178 may be driven through top portion 172 (FIG. 4) of frame 154 and into a corresponding opening in casing 102. In addition, ins some embodiments, one or more mechanical fasteners 178 may be driven through bottom portion 174 (FIG. 4) of frame 154 and into a corresponding opening in casing 102.

In some instances, as noted above, the radius of curvature of curved contact surface 180 of frame 154 may have the same radius of curvature as curved surface 126 of casing 102. Thus, when frame 154 is mounted to casing 102, curved contact surface 180 may be pressed against curved surface 126 of casing 102, and in doing so, curved contact surface 180 engages and immediately conforms to curved surface 126 of casing 102 as they have the same constant radius of curvature. In accordance with exemplary aspects of the present disclosure, frame 154 of control panel assembly 150 is configured to engage and conform to a curved surface of a casing that has a greater radius of curvature than curved contact surface 180 of frame 154. In this way, a single or common frame 154 may be designed to mount to a plurality of different water heater platforms that have a different radius of curvature than the curved contact surface 180 of frame 154.

Figure 6:
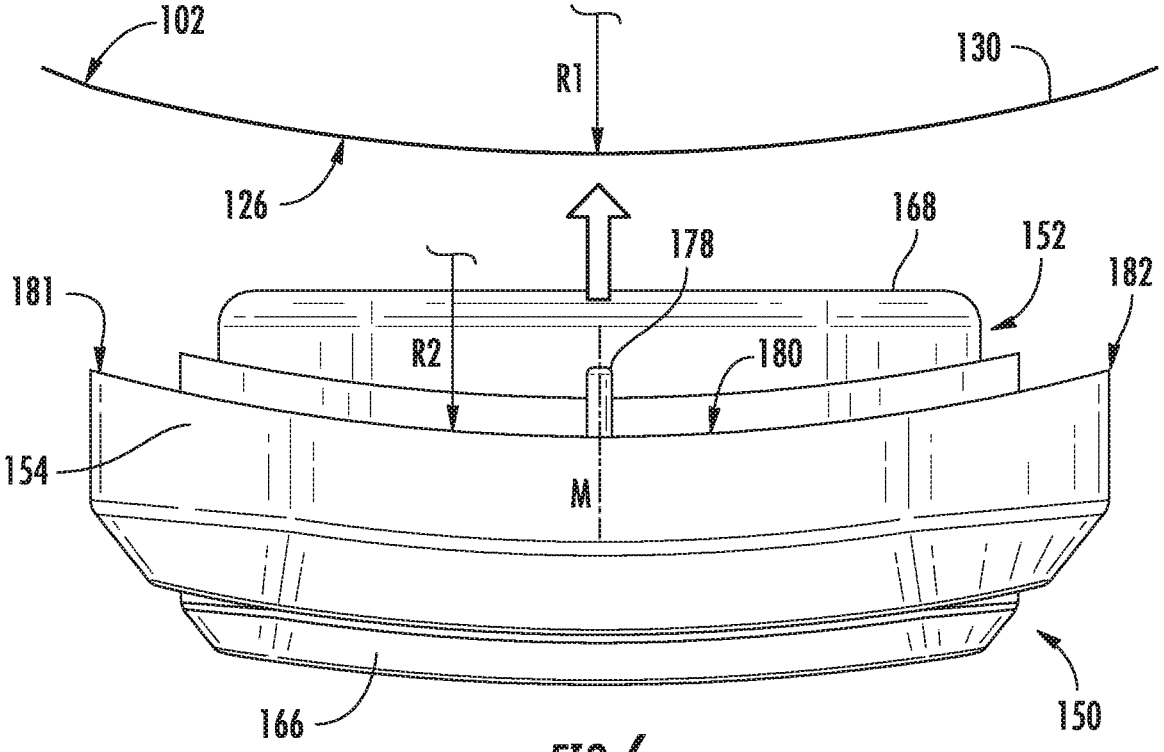
FIGS. 6, 7, and 8 provide various top views of an exemplary control panel assembly in the process of being mounted to a casing of a water heater appliance according to an exemplary embodiment of the present subject matter.
Figure 7:
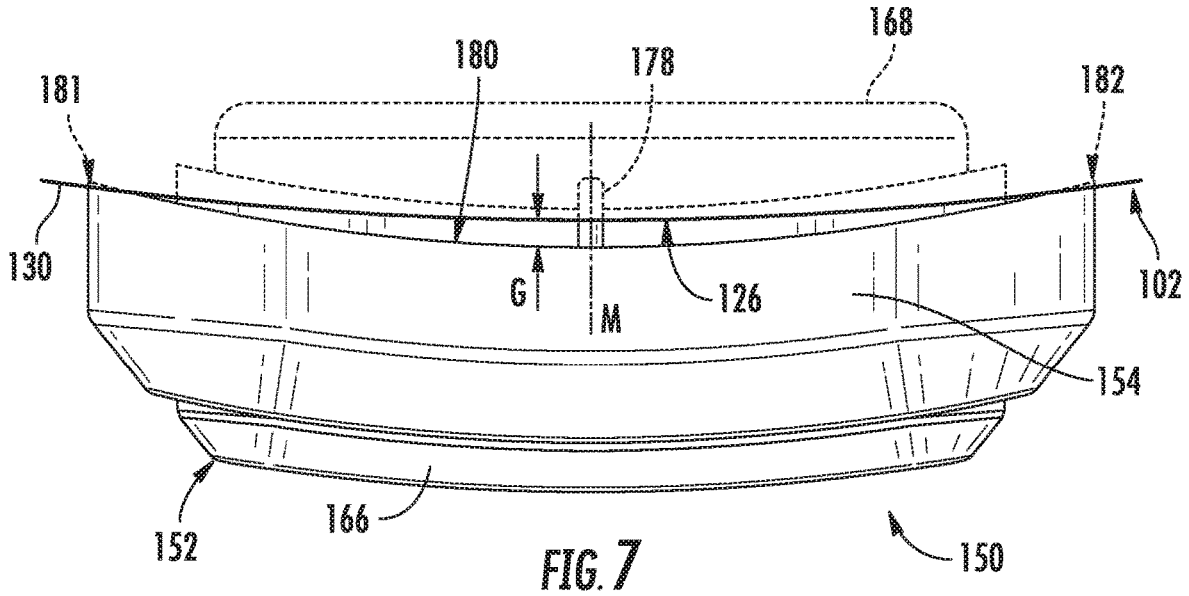
Figure 8:
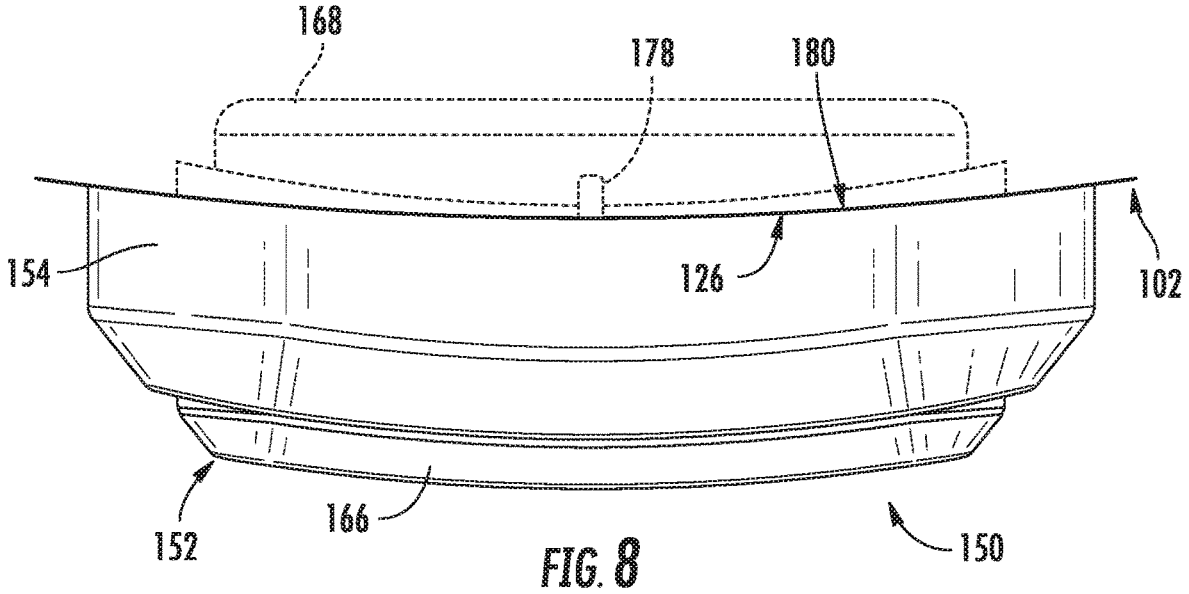

FIGS. 6, 7, and 8 provide various views of one exemplary control panel assembly 150 being mounted to casing 102 of an exemplary water heater appliance in accordance with an exemplary embodiment of the present disclosure. For this embodiment, curved surface 126 is outer surface 128 of wrapper 130. Curved surface 126 has a radius of curvature, denoted as first radius of curvature R1. For this embodiment, first radius of curvature R1 is constant and is fourteen inches (14 in.). Moreover, for this embodiment, curved contact surface 180 of frame 154 has a second radius of curvature R2 that is less than the first radius of curvature R1 of curved surface 126 of casing 102. Particularly, second radius of curvature R2 of curved contact surface 180 is ten inches (10 in.). Moreover, as shown best in FIG. 6, curved contact surface 180 of frame 154 extends between a first contact edge 181 and a second contact edge 182. A midpoint M is defined midway between first contact edge 181 and second contact edge 182 along the arc of curved contact surface 180. Second radius of curvature R2 of curved contact surface 180 is constant or substantially constant along the entire arc from first contact edge 181 and second contact edge 182. Accordingly, the second radius of curvature R2 of curved contact surface 180 is constant between first contact edge 181 and second contact edge 182 and the first radius of curvature R1 of curved surface 126 is constant along an arc in which the curved contact surface 180 is engaged.

To mount frame 154 to casing 102, control panel assembly 150 is first aligned with the desired mounting position on the water heater appliance. More particularly, curved contact surface 180 of frame 154 is aligned with curved surface 126 of casing 102. Curved contact surface 180 of frame 154 is then pressed against curved surface 126 of casing 102. When this occurs, first contact edge 181 and second contact edge 182 of curved contact surface 180 contact or engage curved surface 126 of casing 102. However, as shown best in FIG. 7, a gap G is defined between curved contact surface 180 and curved surface 126 as the radius of curvature of curved surface 126 is greater than the radius of curvature of curved contact surface 180. For instance, as depicted in FIG. 7, gap G is greatest at midpoint M. To close the gap G, frame 154 is elastically deflected such that curved contact surface 180 engages and conforms to curved surface 126 of casing 102. In one exemplary aspect, frame 154 is elastically deflected into engagement and conformance with curved surface 126 of casing 102 by driving mechanical fastener 178 through frame 154 at the midpoint M of curved contact surface 180 and into casing 102. As shown in FIG. 8, mechanical fastener 178 has been driven through frame 154 and into casing 102 to elastically deflect frame 154 into engagement and conformance with curved surface 126. The compliant plastic material and depth of frame 154 allows for frame 154 to elastically deflect into conformance with curved surface 126 such that the substantially all of the arc of curved contact surface 180 engages curved surface 126 of casing 102. Thus, despite the differing radius of curvature of curved surface 126 of casing 102 and curved contact surface 180 of frame 154, curved contact surface 180 may engage and may be deflected into conformance with curved surface 126.

In some embodiments, as noted above, the second radius of curvature R2 of curved contact surface 180 is less than the first radius of curvature R1 of the curved surface 126. As one example, in some embodiments, the first radius of curvature R1 of curved surface 126 is at least ten percent (10%) greater than the second radius of curvature R2 of curved contact surface 180 of frame 154. For instance, the first radius of curvature R1 of curved surface 126 may be eleven inches (11 in.) and the second radius of curvature R2 of curved contact surface 180 may be ten inches (10 in.). As another example, the first radius of curvature R1 of curved surface 126 is at least twenty percent (20%) greater than the second radius of curvature R2 of curved contact surface 180 of frame 154. For instance, the first radius of curvature R1 of curved surface 126 may be twelve inches (12 in.) and the second radius of curvature R2 of curved contact surface 180 may be ten inches (10 in.). As yet another example, the first radius of curvature R1 of curved surface 126 is at least thirty-five percent (35%) greater than the second radius of curvature R2 of curved contact surface 180 of frame 154. For instance, the first radius of curvature R1 of curved surface 126 may be thirteen and a half inches (13.5 in.) and the second radius of curvature R2 of curved contact surface 180 may be ten inches (10 in.). As a further example, the first radius of curvature R1 of curved surface 126 is at least fifty percent (50%) greater than the second radius of curvature R2 of curved contact surface 180 of frame 154. For instance, the first radius of curvature R1 of curved surface 126 may be fifteen inches (15 in.) and the second radius of curvature R2 of curved contact surface 180 may be ten inches (10 in.).

Accordingly, as curved contact surface 180 of frame 154 may engage and conform to a plurality of different curved surfaces 126 of casing 102, a common or standard control panel assembly may be utilized with a plurality of water heater appliances having different curved geometries. For instance, as derived from the examples above, a frame of a control panel assembly having a curved contact surface with a radius of curvature of ten inches (10 in.) may engage and conform to a curved surface of a water heater appliance having a curved surface that has a radius of curvature that is between ten and fifteen inches (10 in.-15 in.). In some instances, the curved contact surface of the frame may be designed for the smallest radius of curvature of a particular family or fleet of water heater appliances.

Figure 13:
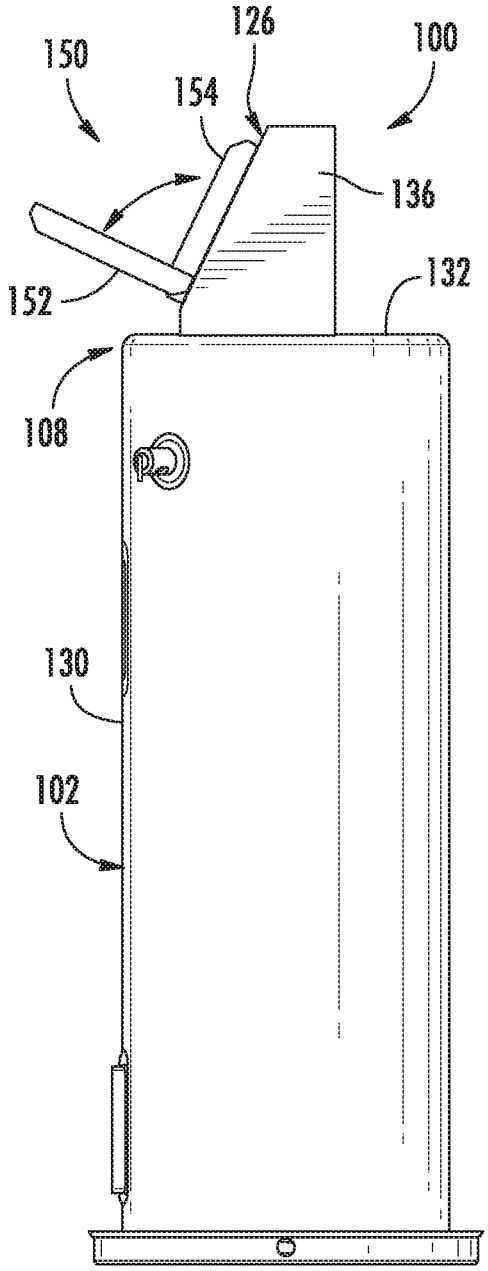
FIG. 13 provides a perspective view of another water heater appliance according to an exemplary embodiment of the present subject matter.
Figure 14:
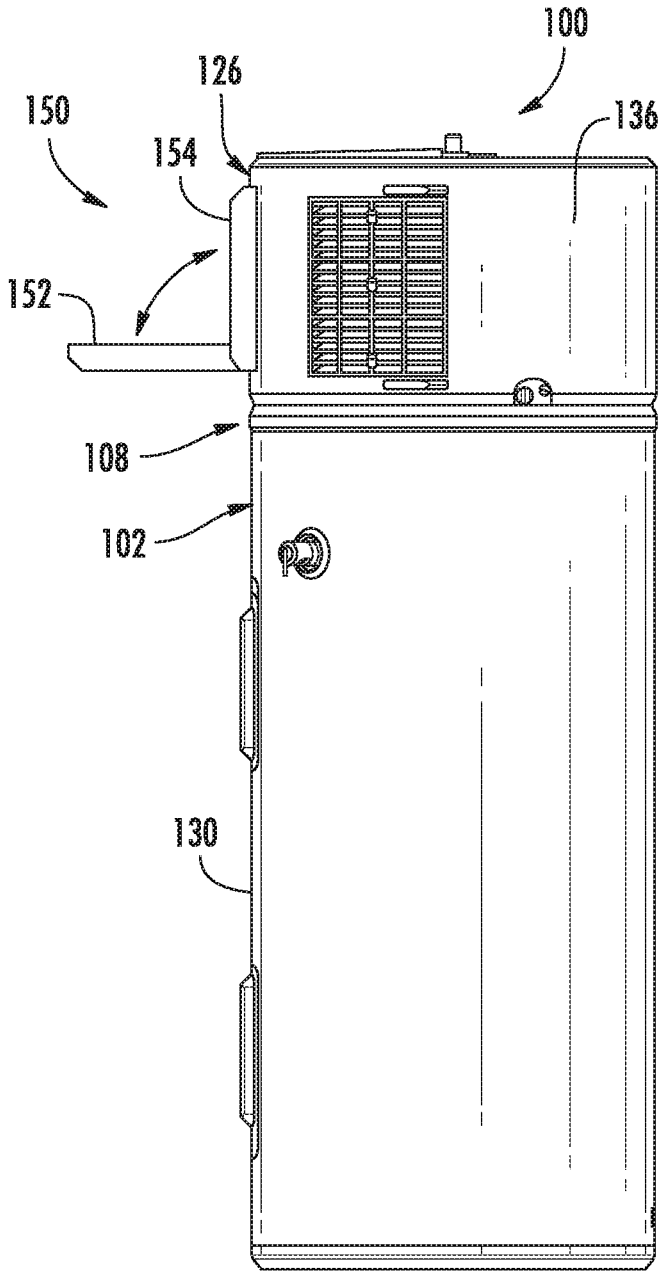
FIG. 14 provides a perspective view of yet another water heater appliance according to an exemplary embodiment of the present subject matter.

Further, with reference to FIGS. 13 and 14, in some embodiments, curved surface 126 may be other surfaces of casing 102 or water heater appliance 100. FIG. 13 provides a perspective view of another water heater appliance 100 and FIG. 14 provides a perspective view of yet another water heater appliance 100. As shown in FIG. 13, casing 102 includes wrapper 130, top cover 132 coupled to wrapper 130 at a top portion 108 of water heater appliance 100, and a shroud 136 mounted to top cover 132. For the depicted embodiment of FIG. 13, curved surface 126 extends along shroud 136. That is, curved surface 126 forms at least a portion of shroud 136 and frame 154 of control panel assembly 150 is mounted thereto in a manner described above. As shown in FIG. 14, casing 102 includes wrapper 130 and shroud 136 and shroud 136 is coupled thereto (i.e., to wrapper 130). For the depicted embodiment of FIG. 14, curved surface 126 extends along shroud 136. That is, curved surface 126 is an outer surface of shroud 136 as illustrated.

Figure 9:
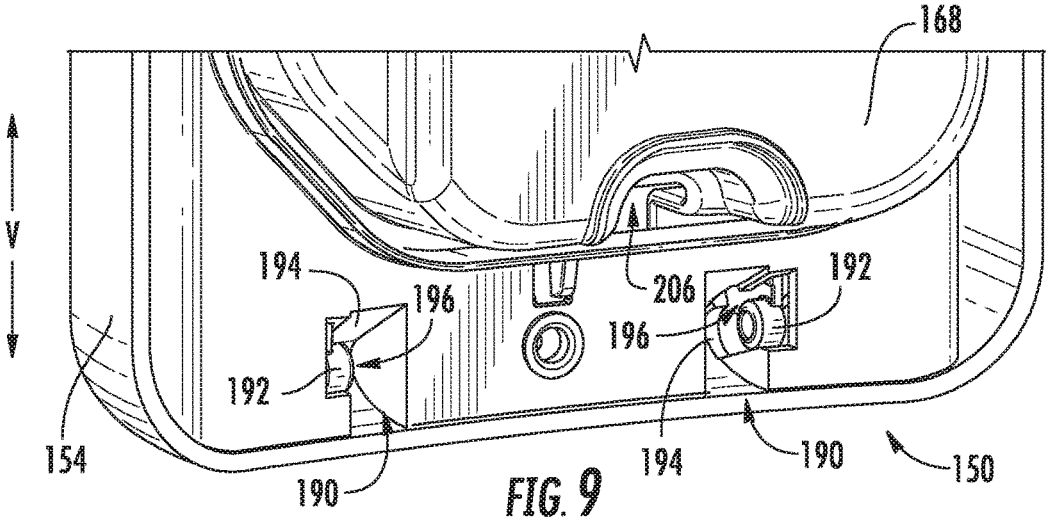
FIG. 9 provides a back perspective view of a bottom portion of the exemplary control panel assembly of FIG. 2.
Figure 10:
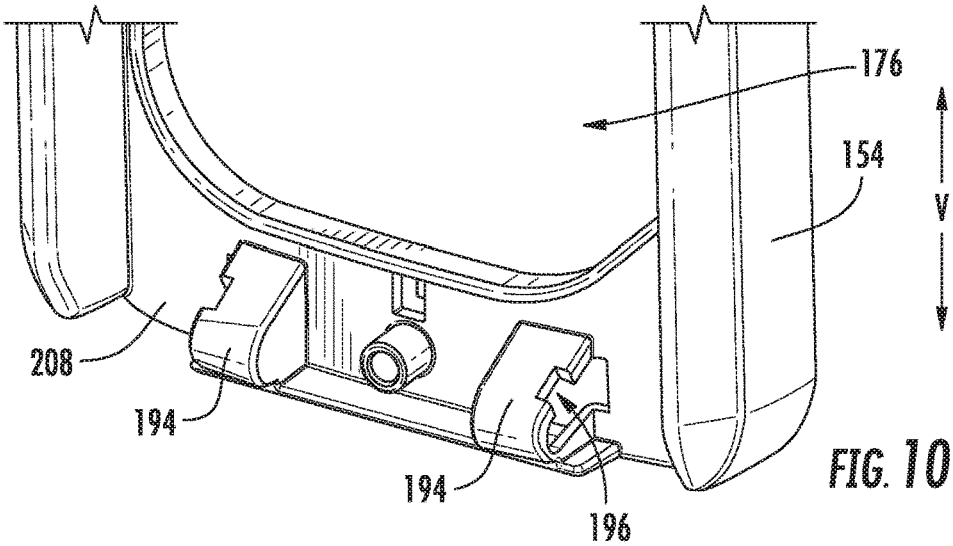
FIG. 10 provides a back perspective view of a bottom portion of a frame of the control panel assembly of FIG. 9.
Figure 11:
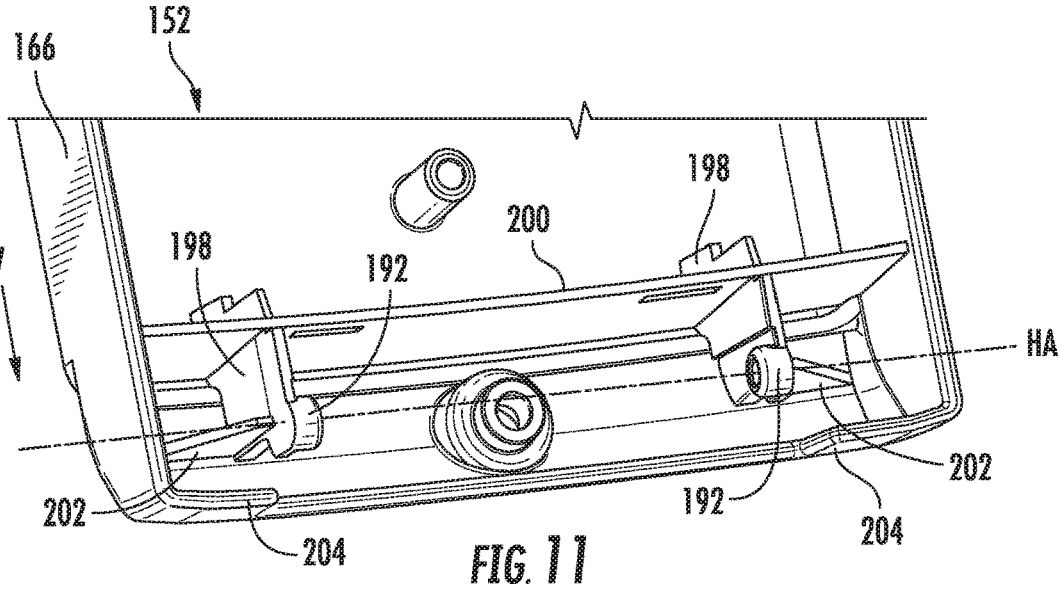
FIG. 11 provides a back perspective view of a bottom portion of a front panel of the control panel assembly of FIG. 9.
Figure 12:
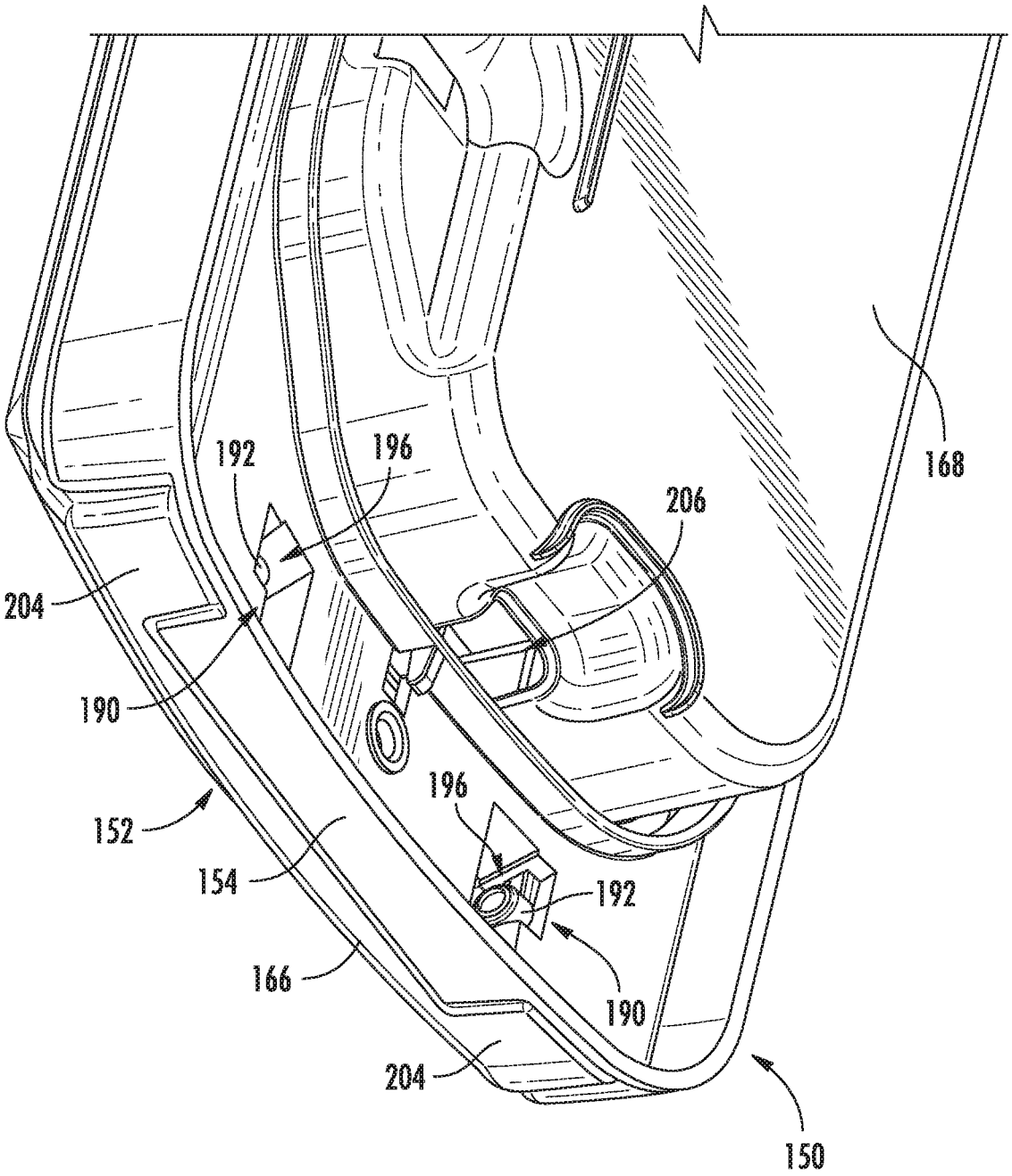
FIG. 12 provides a back perspective view of a bottom portion of the control panel assembly of FIG. 9.

Referring now generally to FIGS. 4, and 9 through 12, various views of control panel assembly 150 are provided depicting features that facilitate rotation of control panel 152 relative to frame 154. More particularly, FIG. 9 provides a back perspective view of a bottom portion of control panel assembly 150. FIG. 10 provides a back perspective view of a bottom portion of frame 154. FIG. 11 provides a back perspective view of a bottom portion of front panel 166 of control panel 152. FIG. 12 provides a back perspective view of a bottom portion of control panel assembly 150.

In some embodiments, as noted previously, control panel 152 is rotatably coupled to frame 154. More particularly, control panel 152 is rotatable about a hinge axis HA between a closed position (FIGS. 1, 2, 3, 9, 12) and an open position (FIG. 4), e.g., by user manipulation or by an electric drive or motor. In the closed position, control panel 152 is oriented along the vertical direction V. Frame 154 defines an opening 176 (FIG. 10) in which control panel 152 is received when control panel 152 is in the closed position. Further, one or more tabs 210 (FIG. 4) may engage frame 154 to secure the top portion of control panel 152 to frame 154 when control panel 152 is in the closed position. For instance, the tabs 210 may engage a groove or aperture defined by frame 154. In the open position, control panel 152 may be oriented at an angle with respect to the vertical direction V, e.g., as shown in FIG. 4. In FIG. 4, control panel 152 is rotated about ninety degrees (90°) with respect to the vertical direction V.

The hinge axis HA is defined by one or more hinges 190 as shown best in FIG. 4. Each hinge 190 includes one or more cylindrical pins 192 defined by or attached to control panel 152 as shown best in FIG. 11. For this embodiment, front panel 166 of control panel 152 defines two (2) pins 192 spaced apart from one another and concentrically aligned along hinge axis HA. Each pin 192 projects from a vertical support 198 that is in turn attached to or integrally formed with a horizontal support 200. Each vertical support 198 extends vertically and may extend through apertures defined by horizontal support 200. Horizontal support 200 extends horizontally (i.e., in a direction orthogonal to the vertical direction V) and spans substantially the width of front panel 166. Horizontal brace members 202 may be integrally formed with or attached to vertical supports 198 to provide additional structural support to vertical supports 198.

When control panel 152 is rotatably coupled to frame 154, e.g., as shown in FIGS. 9 and 12, pins 192 of control panel 152 are each received within a knuckle 194 defined by frame 154. That is, each pin 192 is received within a recess 196 defined by an associated knuckle 194. The recesses 196 of knuckles 194 are generally circular and are sized to receive the cylindrical pins 192. When control panel 152 is rotated about the hinge axis HA, e.g., by user manipulation or by an electric drive or motor, pins 192 rotate within recesses 196 of their respective knuckles 194. The relative motion of pins 192 within their associated knuckles 194 permits control panel 152 to rotate or hinge relative to frame 154.

Notably, for this embodiment, as best shown in FIGS. 2, 9, and 12, one or more electrical wires 164 pass through an opening 206 defined by control panel 152. More particularly, opening 206 is defined by back panel 168 of control panel 152. As shown, opening 206 is defined by control panel 152 adjacent the one or more hinges 190 along the vertical direction V. As hinges 190 are positioned at or proximate bottom portion 174 of frame 154 (FIG. 4), opening 206 is likewise positioned at or proximate bottom portion 174 of frame 154. Accordingly, wires 164 enter control panel assembly 150 at the bottom portion of control panel assembly 150, which is also the location of the hinges 190. Thus, when control panel 152 is moved or rotated about the hinge axis HA, the flex and movement of wires 164 is minimized, which may result in lower wire usage and better reliability of control panel assembly 150.

Further, in some embodiments, as shown best in FIGS. 11, 12, control panel 152 includes one or more mechanical stops 204 for limiting or constraining rotation of control panel 152 about the hinge axis HA. For instance, for this embodiment, mechanical stops 204 limit or constrain rotation of control panel 152 about the hinge axis HA to about ninety degrees (90°). Accordingly, when control panel 152 is moved downward toward the open position, mechanical stops 204 limit or constrain the rotation of control panel 152 to ninety degrees (90°). Thus, control panel 152 is rotatable about ninety degrees (90°) about hinge axis HA between the closed position and the fully open position. Particularly, when control panel 152 is moved downward to about the ninety degree (90°) position as shown in FIG. 4, mechanical stops 204 engage casing 102 and prevent further rotation of control panel 152 relative to frame 154. When mechanical stops 204 engage casing 102, both the mechanical stops 204 and the casing 102 are oriented along the vertical direction V. When control panel 152 is stopped in the ninety degree (90°) position as shown in FIG. 4, an operator is permitted clear, hands-free access to wires 164 and other electronic components within enclosure 170 during assembly or servicing of control panel assembly 150. Thus, when control panel 152 is moved to the open position, reliability and ease of assembly/service may be improved.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A water heater appliance, comprising:

a casing having a curved surface, wherein the curved surface of the casing has a first radius of curvature;

a tank positioned within the casing and defining a chamber for heating water;

a heating source in thermal communication with the tank for selectively heating water within the chamber; and a control panel assembly, comprising:

a control panel; and a frame coupled or integral with the control panel and mounted to the casing, the frame having a curved contact surface engaged with and conforming to the curved surface of the casing, and wherein the curved contact surface of the frame has a second radius of curvature that is less than the first radius of curvature of the curved surface.

2. The water heater appliance of claim 1, further comprising:

a mechanical fastener driven through the curved contact surface of the frame and into the curved surface of the casing to deflect the curved contact surface into conformance with the curved surface.

3. The water heater appliance of claim 2, wherein the curved contact surface of the frame extends between a first contact edge and a second contact edge, and wherein a midpoint is defined between the first contact edge and the second contact edge, wherein the mechanical fastener is driven through the curved contact surface of the frame and into the curved surface of the casing at the midpoint of the curved contact surface.

4. The water heater appliance of claim 3, wherein the second radius of curvature of the curved contact surface is constant between the first contact edge and the second contact edge, and wherein the first radius of curvature of the curved surface is constant along an arc in which the curved contact surface is engaged.

5. The water heater appliance of claim 1, wherein the first radius of curvature of the curved surface of the casing is at least ten percent (10%) greater than the second radius of curvature of the curved contact surface of the frame.

6. The water heater appliance of claim 1, wherein the first radius of curvature of the curved surface of the casing is at least twenty percent (20%) greater than the second radius of curvature of the curved contact surface of the frame.

7. The water heater appliance of claim 1, wherein the first radius of curvature of the curved surface of the casing is at least thirty-five percent (35%) greater than the second radius of curvature of the curved contact surface of the frame.

8. The water heater appliance of claim 1, wherein the casing comprises a wrapper, and wherein the curved surface is an outer surface of the wrapper.

9. The water heater appliance of claim 1, wherein the casing comprises a wrapper, a top cover coupled to the wrapper at a top portion of the water heater appliance, and a shroud mounted to the top cover, and wherein the curved surface extends along the shroud.

10. The water heater appliance of claim 1, wherein the casing comprises a wrapper and a shroud coupled thereto, and wherein the curved surface extends along the shroud.

11. The water heater appliance of claim 1, wherein the frame is formed of a compliant plastic material.

12. The water heater appliance of claim 1, wherein the control panel is rotatably coupled with the frame, wherein the control panel is rotatable between a closed position and an open position.

13. A water heater appliance, comprising:

a casing, the casing has a curved surface having a first radius of curvature;

a tank positioned within the casing and defining a chamber for heating water;

a heating source in thermal communication with the tank for selectively heating water within the chamber;

a control panel assembly, the control panel assembly comprising:

a frame mounted to the casing, the frame has a curved contact surface having a second radius of curvature that is less than the first radius of curvature; and a control panel rotatably coupled with the frame between a closed position and an open position; and a mechanical fastener driven through the curved contact surface of the frame and into the curved surface of the casing, and wherein when the mechanical fastener is driven, the curved contact surface engages and is deflected into conformance with the curved surface of the casing.

14. The water heater appliance of claim 13, wherein the control panel is rotatable about a hinge axis, and wherein the control panel comprises one or more mechanical stops for limiting rotation of the control panel about the hinge axis to about ninety degrees (90°).

15. The water heater appliance of claim 13, wherein the control panel is rotatable about a hinge axis defined by one or more hinges, wherein the one or more hinges comprise one or more pins defined by the control panel and wherein each of the one or more pins are received within a knuckle defined by the frame.

16. The water heater appliance of claim 15, wherein the water heater appliance defines a vertical direction, and wherein the water heater appliance further comprises:

one or more electrical wires, wherein the one or more electrical wires pass through an opening defined by the control panel, and wherein the opening is defined by the control panel adjacent the one or more hinges along the vertical direction.

17. The water heater appliance of claim 16, wherein the frame extends between a top portion and a bottom portion along the vertical direction, and wherein the one or more hinges are positioned proximate the bottom portion of the frame.

18. A water heater appliance defining a vertical direction and a horizontal direction, the water heater appliance comprising:

a casing having a curved surface that has a first radius of curvature;

a tank positioned within the casing and defining a chamber for heating water;

a heating source in thermal communication with the tank for selectively heating water within the chamber; and a control panel assembly, the control panel assembly comprising:

a frame mounted to the casing, the frame having a curved contact surface engaged with and conforming to the curved surface of the casing, and wherein the curved contact surface of the frame has a second radius of curvature that is less than the first radius of curvature of the curved surface; and a control panel rotatably coupled with the frame between a closed position and an open position, the control panel being rotatable about a hinge axis that extends along the horizontal direction.

19. The water heater appliance of claim 18, wherein the control panel is oriented lengthwise along the vertical direction in the closed position and oriented lengthwise along the horizontal direction in the open position.

20. The water heater appliance of claim 18, wherein the control panel comprises one or more mechanical stops for limiting rotation of the control panel about the hinge axis to about ninety degrees (90°).

* * * * *